United States Patent [19]

Chang et al.

[11] Patent Number: 4,650,519

[45] Date of Patent: Mar. 17, 1987

[54] NICKEL ALUMINIDE COMPOSITIONS

[75] Inventors: Keh-Minn Chang, Schenectady; Shyh-Chin Huang, Latham; Alan I. Taub, Schenectady, all of N.Y.

[73] Assignee: General Electric Company, Schenectady, N.Y.

[21] Appl. No.: 783,716

[22] Filed: Oct. 3, 1985

[51] Int. Cl.[4] ..... C22C 32/00

[52] U.S. Cl. ..... 75/246; 75/244; 75/82; 148/162; 420/460; 420/590; 419/23; 419/25; 419/49; 419/68; 419/62

[58] Field of Search ..... 75/82; 148/162; 420/460, 590; 75/0.5 C, 129, 244, 246; 419/23, 25, 49, 68, 62

[56] References Cited

U.S. PATENT DOCUMENTS

| | | | |
|---|---|---|---|
| 2,755,184 | 7/1956 | Turner et al. | 420/460 |
| 3,653,976 | 4/1972 | Miller et al. | 420/460 |
| 3,902,900 | 9/1975 | Restall et al. | 420/449 |
| 3,922,168 | 11/1975 | Restall et al. | 420/448 |
| 4,379,720 | 4/1983 | Ray et al. | 420/460 |
| 4,478,791 | 10/1984 | Huang et al. | 420/449 |

OTHER PUBLICATIONS

C. T. Liu & C. C. Koch, "Development of Ductile Polycrystalline $Ni_3Al$ For High-Temperature Applications", Technical Aspects of Critical Materials Use by the Steel Industry, NBSIR 83-2679-2, vol. IIB (Jun. 1983), Center for Materials Science, U.S. Dept. of Commerce, Nat'l. Bureau of Standards.

*Primary Examiner*—Stephen J. Lechert, Jr.
*Attorney, Agent, or Firm*—Paul E. Rochford; James C. Davis, Jr.; Paul R. Webb, II

[57] ABSTRACT

A metal body having high tensile strength and ductility at temperatures over 1000° F. is provided. The body is prepared by hot isostatic pressing of powder formed by atomization of a melt of an alloy. The alloy composition is according to the formula $$(Ni_{1-x-z}Co_xAl_z)_{100-y}B_y$$

wherein x is at least 0.05, and
wherein y is 0.10 to 2.0, and
wherein z is 0.23 to 0.25.

The consolidated body is suitable for machining to final dimensions. To relieve stresses developed from the machining the body may be annealed for a couple of hours at temperatures between 800° C. and 1200° C.

11 Claims, 2 Drawing Figures

NICKEL ALUMINIDE COMPOSITIONS

BACKGROUND OF THE INVENTION

The present invention relates generally to compositions having a tri-nickel aluminide base. More specifically, it relates to cobalt containing aluminides which may be consolidated into useful articles.

It is known that polycrystalline tri-nickel aluminide castings exhibit properties of extreme brittleness, low strength and poor ductility at room temperature.

The single crystal tri-nickel aluminide in certain orientations does display a favorable combination of properties at room temperature including significant ductility. However, the polycrystalline material which is conventionally formed by known processes does not display the desirable properties of the single crystal material and, although potentially useful as a high temperature structural material, has not found extensive use in this application because of the poor properties of the material at room temperature.

It is known that nickel aluminide has good physical properties at temperatures above 1000° F. and could be employed, for example, in jet engines as component parts at operating or higher temperatures. However, if the material does not have favorable properties at room temperature and below the part formed of the aluminide may break when subjected to stress at the lower temperatures at which the part would be maintained prior to starting the engine and prior to operating the engine at the higher temperatures.

Alloys having a tri-nickel aluminide base are among the group of alloys known as heat-resisting alloys or superalloys. These alloys are intended for very high temperature service where relatively high stresses, including tensile, thermal, vibratory and shock, are encountered and where oxidation resistance is frequently required.

Accordingly, what has been sought in the field of superalloys is an alloy composition which displays favorable stress resistant properties not only at the elevated temperatures at which it may be used, as for example in a jet engine, but also a practical and desirable and useful set of properties at the lower temperatures to which the engine is subjected in storage and mounting and starting operations. For example, it is well known that an engine may be subjected to severe subfreezing temperatures while standing on an airfield or runway prior to starting the engine.

Significant efforts have been made toward producing a tri-nickel aluminide and similar superalloys which may be useful over such a wide range of temperature and adapted to withstand the stress to which the articles made from the material may be subjected in normal operations over such a wide range of temperatures.

For example, U.S. Pat. No. 4,478,791, assigned to the same assignee as the subject application, teaches a method by which a significant measure of ductility can be imparted to a tri-nickel aluminide base metal at room temperature to overcome the brittleness of this material.

Also, copending application of the same inventors of the subject application Ser. No. 647,326; filed Sept. 9, 1984, and incorporated herein by reference, teaches a method by which the composition and methods of the U.S. Pat. No. 4,478,791 may be further improved by additions of cobalt.

Also, copending applications of the same inventors as the subject application, Ser. Nos. 647,327; 647,328; 646,877 and 646,879 filed Sept. 4, 1984 also teach methods by which the composition and methods of U.S. Pat. No. 4,478,791 may be further improved. These applications are incorporated herein by reference.

For the unmodified binary intermetallic, there are many reports in the literature of a strong dependence of strength and hardness on compositional deviations from stoichiometry. E. M. Grala in "Mechanical Properties of Intermetallic Compounds", Ed. J. H. Westbrook, John Wiley, New York (1960) p. 358, found a significant improvement in the room temperature yield and tensile strength in going from the stoichiometric compound to an aluminum-rich alloy. Using hot hardness testing on a wider range of aluminum compositions, Guard and Westbrook found that at low homologous temperatures, the hardness reached a minimum near the stoichiometric composition, while at high homologous temperature the hardness peaked at the 3:1 Ni:Al ratio. Trans. TMS-AIME 215 (1959) 807. Compression tests conducted by Lopez and Hancock confirmed these trends and also showed that the effect is much stronger for Al-rich deviations than for Ni-rich deviations from stoichiometry. Phys. Stat. Sol. A2 (1970) 469. A review by Rawlings and Staton-Bevan concluded that in comparison with Ni-rich stoichiometric deviations, Al-rich deviations increase not only the ambient temperature flow stress to a greater extent, but also that the yield stress-temperature gradient is greater. J. Mat. Sci. 10 (1975) 505. Extensive studies by Aoki and Izumi report similar trends. Phys. Stat. Sol. A32 (1975) 657 and Phys. Stat. Sol. A38 (1976) 587. Similar studies by Noguchi, Oya and Suzuka also reported similar trends. Met. Trans. 12A (1981) 1647.

More recently, an article by C. T. Liu, C. L. White, C. C. Koch and E. H. Lee appearing in the "Proceedings of the Electrochemical Society on High Temperature Materials", ed. Marvin Cubicciotti, Vol. 83-7, Electrochemical Society, Inc. (1983) p. 32, discloses that the boron induced ductilization of the same alloy system is successful only for aluminum lean $Ni_3Al$.

In addition an article dealing with tri-nickel aluminide is reported by C. T. Liu and C. C. Koch, entitled "Development of Ductile Polycrystalline $Ni_3Al$ For High Temperature Applications", in Technical Aspects of Critical Material Use by the Steel Industry, NBSIR 83-2679-2, Volume IIB, June 1983, Center for Materials Science, U.S. Dept. of Commerce, National Bureau of Standards.

The subject application presents a further improvement in the nickel aluminide to which significant increased ductilization has been imparted.

BRIEF SUMMARY OF THE INVENTION

It is accordingly one object of the present invention to provide a method of forming an article adapted to use in structural parts at room temperature as well as at elevated temperatures of over 1000° F.

Another object is to provide an article suitable for withstanding significant degrees of stress and for providing appreciable ductility at room temperature as well as at elevated temperatures of over 1000° F.

Another object is to provide a consolidated material which can be formed into useful parts having the combination of properties of significant strength and ductility at room temperature and elevated temperatures of over 1000° F.

Another object is to provide a consolidated material which is suitable for cold rolling, extrusion, and isothermal forming, and the like.

Another object is to provide parts consolidated from powder which have a set of properties useful in applications such as jet engines and which may be subjected to a variety of forms of stress.

Other objects will be in part apparent and in part set forth in the description which follows.

In one of its broader aspects an object of the present invention may be achieved by providing a melt having a tri-nickel aluminide base and containing a relatively small percentage of boron and between 5 and 20 atomic % of cobalt. The melt is then atomized by inert gas atomization. The melt is rapidly solidified to powder during the atomization. The material is then consolidated by hot isostatic pressing at suitable temperature, pressure and time. For example such consolidation may be at a temperature of about 1150° C. and at about 15 ksi for about two hours.

The isostatically pressed sample is suitable for machining into parts having final dimensions. For a part which has been machined it may be desirable to relieve stresses caused by the machining. For such purpose the part may be annealed at high temperatures ranging from 800° to 1200° C. for two hours.

Although the melt referred to above should ideally consist only of the atoms of the intermetallic phase and atoms of boron, it is recognized that occasionally and inevitably other atoms of one or more incidental impurity atoms may be present in the melt.

As used herein the expression tri-nickel aluminide base composition refers to a tri-nickel aluminide which contains impurities which are conventionally found in nickel aluminide compositions. It includes as well other constituents and/or substituents which do not detract from the unique set of favorable properties which are achieved through practice of the present invention.

BRIEF DESCRIPTION OF THE DRAWINGS

The description of the invention which follows will be understood with greater clarity by reference to the accompanying drawing in which.

DETAILED DESCRIPTION OF THE INVENTION

Figure 1:
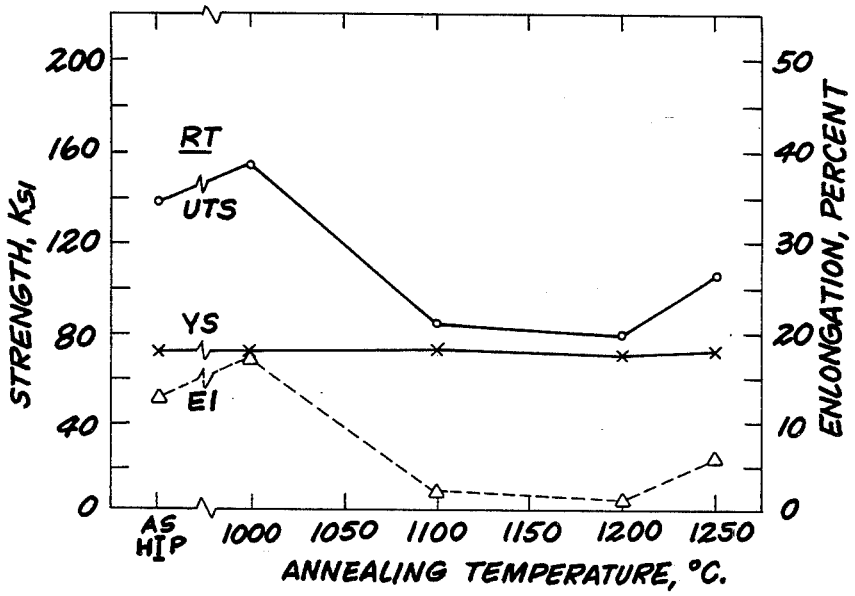
FIG. 1 is a graph of yield and tensile strengths in ksi and ductility, measured as percent elongation, are plotted against annealing temperature as abscissa.

By a substituent metal or partial substituent is meant a metal which takes the place of and in this way is substituted for another and different ingredient metal, where the other ingredient metal is part of a desirable combination of ingredient metals, which ingredient metals form the essential constituents of an alloy system.

For example, in the case of the superalloy system $Ni_3Al$, or nickel base superalloy, the ingredient or constitutent metals are nickel and aluminum. The metals are present in the approximate stoichiometric atomic ratio of 3 nickel atoms for each aluminum atom in this system.

Nickel aluminide is found in the nickel-aluminum binary system and as the gamma prime phase of conventional gamma/gamma prime nickel-base superalloys. Nickel aluminide has high hardness and is stable and resistant to oxidation and corrosion at elevated temperatures which makes it attractive as a potential structural material.

Nickel aluminide, which has a face centered cubic (FCC) crystal structure of the $Cu_3Al$ type ($Ll_2$ in the Stukturbericht designation which is the designation used herein and in the appended claims) with a lattice parameter $a_o=3.589$ at 75 at.% Ni and melts in the range of from about 1385° to 1395° C., is formed from aluminum and nickel which have melting points of 660° and 1453° C., respectively. Although frequently referred to as $Ni_3Al$, nickel aluminide is an intermetallic phase and not a compound as it exists over a range of compositions as a function of temperature, e.g., about 72.5 to 77 at.% Ni (85.1 to 87.8 wt.%) at 600° C.

Polycrystalline $Ni_3Al$ is quite brittle and shatters under stress as applied in efforts to form the material into useful objects or to use such an article.

It was discovered that the inclusion of boron in the rapidly cooled and solidified alloy system can impart desirable ductility to the rapidly solidified alloy as taught in U.S. Pat. No. 4,478,791.

It has been discovered that a certain metal can be beneficially substituted in part for the constituent metal nickel and hence this substituted metal is designated and known herein as a substituent metal, i.e. as a nickel substituent in the $Ni_3Al$ structure. Moreover, it has been discovered that valuable and beneficial properties are imparted to the rapidly solidified compositions which have the stoichiometric proportions but which have a substituent metal as a quaternary ingredient of such a rapidly solidified alloy system. This discovery is described in copending application Ser. No. 647,326 filed Sept. 9, 1984 and assigned to the same assignee as the subject application. This application is incorporated herein by reference.

The alloy compositions of the prior and also of the present invention must also contain boron as a tertiary ingredient as taught herein and as taught in U.S. Pat. No. 4,478,791, and must further contain a quaternary component or ingredient as taught in the subject specification. A preferred range for the boron tertiary additive is between 0.5 and 1.5%.

By the prior teaching of U.S. Pat. No. 4,478,791, it was found that the optimum boron addition was in the range of 1 atomic percent and permitted a yield strength value at room temperature of about 100 ksi to be achieved for the rapidly solidified product. The fracture strain of such a product was about 10% at room temperature.

The composition which is formed must have a preselected intermetallic phase having a crystal structure of the $Ll_2$ type and must have been formed by cooling a melt at a cooling rate of at least about $10^3$° C. per second to form a solid body the principal phase of which is of the $Ll_2$ type crystal structure in either its ordered or disordered state. The melt composition from which the structure is formed must have the first constituent, nickel, and second constituent, aluminum, present in the melt in an atomic ratio of approximately 3:1.

Further, it has been observed that in the case where an equiaxed structure is formed with the quaternary composition of nickel, aluminum, boron and cobalt, by rapid solidification, the properties of the composition are substantially better on the average than in those cases where the non-equiaxed structure is formed. The equiaxed structure is believed to result from recrystallization. It is known that recrystallization can readily occur in a single-phase material.

The addition of the cobalt as a quaternary ingredient and as a substituent for nickel at about a 5 atomic percent level apparently does not form borides or beta phases under the influence of the rapid solidification process.

Further study was made of the rapidly solidified compositions containing the substituent cobalt as a quaternary additive. The cobalt additive was a substituent for nickel and the concentration of nickel was decreased as the concentration of cobalt was increased. The concentration of the cobalt may be increased, as described in copending application Ser. No. 647,326 referenced above, from x=0.05 to x=0.3 in the expression:

$$(Ni_{0.75-x}Co_xAl_{0.25})_yB_{100-y}.$$

In the practice of this invention, an intermetallic phase having an $Ll_2$ type crystal structure is important. It is achieved in alloys of this invention as a result of rapid solidification. It is important that the $Ll_2$ type crystal structure be preserved in the products which are annealed for consolidation after rapid solidification.

By an atomization the melt is rapidly cooled at a rate in excess of $10^3$° C./sec. to form solid particle bodies the principal phase of which is of the $Ll_2$ type crystal structure in either its ordered or disordered state. Thus, although the rapidly solidified solid bodies will principally have the same crystal structure as the preselected intermetallic phase, i.e., the $Ll_2$ type, the presence of other phases, e.g., borides, is possible. Since the cooling rates are high, it is also possible that the crystal structure of the rapidly solidified solid will be disordered, i.e., the atoms will be located at random sites on the crystal lattice instead of at specific periodic positions on the crystal lattice as is the case with ordered solid solutions.

The invention and the advantages made possible by the invention will be made clearer by reference to the following examples.

EXAMPLE 1

A batch of powder was prepared from a melt comprising $Ni_3Al$ plus 1 atomic % boron. The melt was atomized by processes such as those taught in copending applications of S. A. Miller, Ser. No. 584,687; Ser. No. 584,688; Ser. No. 584,689; Ser. No. 584,690 and Ser. No. 584,691 assigned to the assignee hereof. The substance of these applications is incorporated herein by reference. Other and conventional atomization processes may be employed to form rapidly solidified powder to be consolidated.

A fraction of the powder product which had a particle size of one hundred mesh or smaller was separated from the atomized material.

The powder sample was consolidated by a hot isostatic pressing (HIP) at 1165° C.±10° C. for two hours at a pressure of about 15 ksi.

The consolidated sample was divided and portions were subjected to different annealing temperatures for approximately two hours followed by a salt bath quench.

The samples annealed at the different temperatures were tested at room temperature and the results of the tests are plotted in FIG. 1. It will be noted from FIG. 1 that the room temperature yield strength which was approximately 70 ksi for the as-formed hot isostatically-pressed sample (as HIPped) remained at approximately 70 ksi for the various annealing temperatures.

The ultimate tensile strength was improved by about 10% by the anneal to 1000° C. for the two hour period. However, the sample annealed at 1100 and 1200 had substantially lower ultimate tensile strength. The strength reduction was about 45%.

The elongation of the as-HIPped material was approximately 13% and this was improved to approximately 17% by an anneal at 1000° C. However, annealing at 1100° C. or 1200° C. resulted in substantially lower elongations of the order of 2 or 3%.

FIG. 1 shows the tensile properties measured at room temperature of a tri-nickel aluminide alloy containing 1 atomic % boron. In the as-consolidated condition, the alloy exhibits approximately 13% elongation despite the high temperature of the consolidation. In this Example, the HIP temperature was in the annealing range. High temperature annealing does cause embrittlement when specimens are heat treated between 1100° C. and 1200° C. inasmuch as room temperature elongation is decreased to about 3%, whereas the as-consolidated room temperature elongation is approximately 13%. On the other hand, annealing at 1000° C. appears to improve the ductility slightly.

It is also evident from the Figure that yield strength remains almost constant and appears to be independent of the annealing temperature.

EXAMPLE II

A melt having the composition $$(Ni_{0.65}Co_{0.10}Al_{0.25})_{99}B_1$$

was prepared and the melt was atomized in an argon atmosphere as described in Example I.

Approximately 7.25 pounds of powder were prepared by the atomization process. The atomization was carried out as described in Example 1.

A sample of the powder was hot isostatic pressed (HIPped) at 1143° C.±10° C. at about 15 ksi for two hours. The powder used in hot isostatic pressing in this and the prior example was −100 mesh.

Following the hot isostatic pressing at 1143° C. the sample was separated into a number of samples which were annealed at high temperatures ranging from 1000° C. to 1250° C. for two hours followed by a salt bath quench. Tensile properties, yield strength and elongation were measured in the same manner as for the Example 1 above. The results of the tests made are plotted in FIG. 2 on a graph having coordinates corresponding to those of FIG. 1.

In comparison with FIG. 1, it is evident that substantially improved values were obtained from the room temperature measurements made particularly for those samples which were annealed at temperatures up to 1200° C. The cobalt addition to the composition of Example II is deemed responsible for the improvement.

The yield strength increased from a value of about 70 ksi for the sample of Example I to a value of about 80 ksi for the sample of Example II both for the as HIPped and for the as-annealed conditions at temperatures up to 1200° C. The yield strength of the sample of Example II dropped to about 75 ksi after a two hour anneal at 1250° C.

In this Example, as in the previous Example I, the yield strength is shown to be relatively independent of the annealing temperature. The evidence from this Example II is that the addition of cobalt provides an increase of approximately 10 ksi, or about 14%, in yield strength and this increase is deemed to be the result of solid solution strengthening.

Please note that the as-HIPped values of Example II increased substantially compared to the values of Example I. However what is more important is that there was no rapid drop off in the values of the ultimate tensile strength or of the ductility when the examples of Example II were annealed at the 1100° C. and 1200° C. temperature. This result contrasts with sharp decline in values observed for the cobalt free composition of Example I between the sample annealed at 1000° C. as compared to one annealed at 1100° C. or 1200° C.

The ultimate tensile strength is substantially higher for the Example II material as compared to that of Example I having an as-formed ultimate tensile strength of over 200 ksi for the cobalt containing material as compared to an as-formed ultimate tensile strength of less than 140 ksi for the Example I material. This is an increase of about 43%.

Ultimate tensile strength for the material of Example II remained essentially much higher than that of Example I after the 1000° or 1100° anneal for two hours. This small drop in ultimate strength after anneal at 1100° and 1200° C. contrasted sharply with the sharp drop which was observed for the material of Example I. The sharp contrast is evident by comparison of the top line plotted in FIG. 2 as contrasted with the top line plotted in FIG. 1. The anneal at 1200° led to a further slight drop in the ultimate tensile strength to about 170 ksi. This is still significantly higher (about 100%) than the strength of 85 ksi of the sample prepared according to the method of Example I under the same anneal conditions. The further anneal at 1250° caused further drop in the values of the ultimate tensile strength.

A highly significant improvement is made in the ductility property of the cobalt bearing material of Example II as contrasted with the cobalt-free material of Example I.

Figure 2:
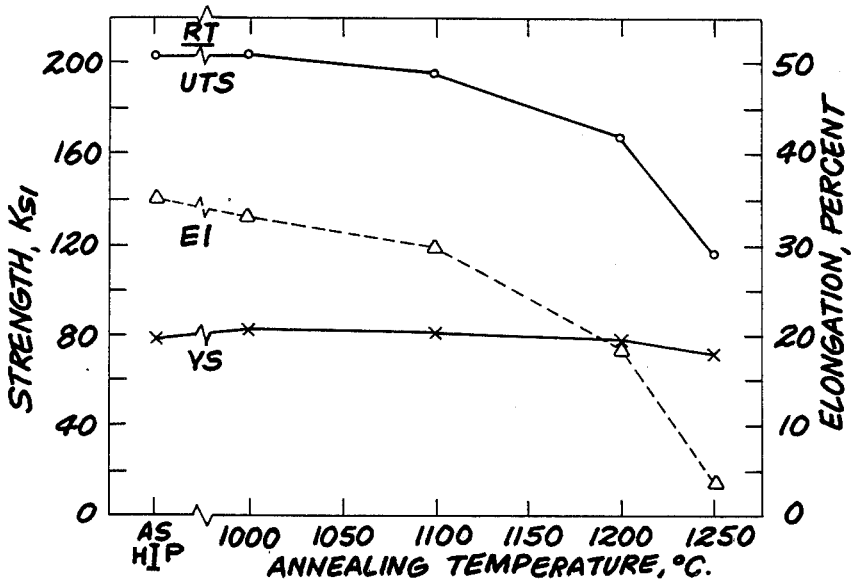
FIG. 2 is a similar plot of measurements made with a material having a different composition, and particularly a composition containing cobalt as a partial substituent for nickel.

The significance is evident from the contrast of the ductility plot of FIG. 2 as contrasted with that of FIG. 1.

In FIG. 1 a maximum ductility of 17% is observed after a 1000° C. anneal. The as-cast cobalt bearing material of FIG. 2 displayed a ductility more than twice as great.

Even more significant is the shape of the curve presenting the ductility rate of FIG. 2 in relation to FIG. 1. In FIG. 2 the ductility values are seen to start high and to decrease gradually so that a ductility of about 18% remains even after an anneal at 1200° C. The irregular ductility curve of FIG. 1 portrays a relatively lower ductility to start and less favorable values at each anneal temperature of 1000° C., 1100° C. and 1200° C. Moreover after an anneal at 1100° C. the ductility of the cobalt containing material of FIG. 2 is ten fold greater (about 30%) than the comparable material (about 3%) of FIG. 1.

What is claimed and sought to be protected by Letters Patent of the United States is as follows:

1. A method of producing an article of a tri-nickel aluminide base alloy of improved strength and ductility which comprises, forming a melt of a boron doped tri-nickel aluminide of the following composition $$(Ni_{1-x-z}Co_xAl_z)_{100-y}B_y$$

wherein x is at least 0.05, and
wherein y is 0.10 to 2.0, and
wherein z is 0.23 to 0.25, rapidly solidifying the melt by gas atomization of the melt to fine particles, consolidating the particles so produced by hot isostatic pressing for a time and at a temperature above 1000° C., and a pressure above 15 ksi to form a dense article, and annealing the formed article at a temperature above about 800° C.

2. The method of claim 1 wherein x is between 0.05 and 0.3.

3. The method of claim 1 wherein x is between 0.05 and 0.2.

4. The method of claim 1 wherein x is about 0.10.

5. The method of claim 1 wherein the consolidated particles are −100 mesh.

6. The method of claim 1 wherein the consolidating temperature is between 1000° and 1200° C.

7. The method of claim 1 wherein the consolidating temperature is about 1150° C.

8. The method of claim 1 wherein the annealing temperature is between 800° C. and 1200° C.

9. The method of claim 1 wherein the annealing temperature is about 1000° C.

10. The method of claim 1 wherein the boron content is about 1.0 atom percent.

11. An article having high tensile strength and elongation properties at temperatures of over 1000° F. which comprises a body of particles consolidated to a coherent structure, said particles having a $L1_2$ crystalline structure, said particles having a boron doped tri-nickel aluminide base composition according to the formula $$(Ni_{1-x-z}Co_xAl_z)_{100-y}B_y$$

wherein x is at least 0.05, and
wherein y is 0.10 to 2.0, and
wherein z is 0.23 to 0.25 and said body having tensile strength greater than about 200 ksi and an elongation greater than about 30% at room temperature.

* * * * *